US009628884B2

(12) United States Patent
Pare et al.

(10) Patent No.: US 9,628,884 B2
(45) Date of Patent: Apr. 18, 2017

(54) ROUTING CONDUCTORS TO ELECTRO-ACOUSTIC TRANSDUCER VOICE COILS

(71) Applicant: Bose Corporation, Framingham, MA (US)

(72) Inventors: Christopher A. Pare, Franklin, MA (US); Adam Sears, Shrewsbury, MA (US); George Nichols, Dover, MA (US)

(73) Assignee: Bose Corporation, Framingham, MA (US)

( * ) Notice: Subject to any disclaimer, the term of this patent is extended or adjusted under 35 U.S.C. 154(b) by 33 days.

(21) Appl. No.: 14/610,328

(22) Filed: Jan. 30, 2015

(65) Prior Publication Data

US 2016/0227325 A1 Aug. 4, 2016

(51) Int. Cl.

| | |
|---|---|
| ***H04R 1/06*** | (2006.01) |
| ***H04R 9/02*** | (2006.01) |
| *H04R 9/04* | (2006.01) |

(52) U.S. Cl.

CPC ..... *H04R 1/06* (2013.01); *H04R 9/025* (2013.01); *H04R 9/046* (2013.01); *H04R 2209/024* (2013.01); *H04R 2307/207* (2013.01)

(58) Field of Classification Search

CPC ... H04R 1/04; H04R 1/06; H04R 9/02; H04R 9/025; H04R 9/04; H04R 9/046; H04R 2209/024; H04R 2231/003; H04R 2307/207

See application file for complete search history.

(56) References Cited

U.S. PATENT DOCUMENTS

| | | | | |
|---|---|---|---|---|
| 4,807,295 | A | 2/1989 | Dombroski | |
| 4,829,582 | A | 5/1989 | Heuvinck | |
| 5,583,944 | A | 12/1996 | Morohoshi et al. | |
| 5,847,333 | A * | 12/1998 | D'Hoogh | H04R 7/20 181/156 |
| 6,175,637 | B1 * | 1/2001 | Fujihira | H04R 9/025 381/401 |
| 6,817,084 | B2 | 11/2004 | Tokusho et al. | |
| 8,538,060 | B2 | 9/2013 | Liu et al. | |
| 2003/0156732 | A1 | 8/2003 | Hong | |
| 2004/0131223 | A1 * | 7/2004 | Stiles | H04R 9/025 381/412 |
| 2004/0179711 | A1 | 9/2004 | Park et al. | |

(Continued)

FOREIGN PATENT DOCUMENTS

| | | | | |
|---|---|---|---|---|
| DE | 19928241 B4 * | 2/2006 | | H04R 1/06 |
| EP | 0821540 A2 * | 5/1998 | | H04R 9/04 |

(Continued)

*Primary Examiner* — Curtis Kuntz
*Assistant Examiner* — Joshua Kaufman
(74) *Attorney, Agent, or Firm* — Bose Corporation

(57) ABSTRACT

An electro-acoustic transducer includes a cone, a voice coil connected to the cone, and magnetic circuit that defines a gap within which the voice coil is disposed. The magnetic circuit is configured for creating magnetic flux across the gap for the voice coil to interact with, thereby to drive motion of the cone. A conductor is included for providing an input signal to the voice coil. A first portion of the conductor is fixedly secured to the magnetic circuit such that the first portion of the conductor does not move relative to the magnetic circuit while the cone is in motion.

16 Claims, 16 Drawing Sheets

(56) References Cited

U.S. PATENT DOCUMENTS

| | | | | |
|---|---|---|---|---|
| 2006/0171555 | A1* | 8/2006 | Brandt | H04R 1/06 381/396 |
| 2008/0205688 | A1 | 8/2008 | Sato | |
| 2008/0298629 | A1* | 12/2008 | Huang | H04R 9/06 381/398 |
| 2013/0223670 | A1 | 8/2013 | Kim et al. | |
| 2015/0326975 | A1* | 11/2015 | Takada | H04R 3/00 381/407 |

FOREIGN PATENT DOCUMENTS

| | | | |
|---|---|---|---|
| JP | H06296298 | A | 10/1994 |
| JP | 2009200919 | A | 9/2009 |
| JP | 4820445 | B2 | 11/2011 |
| JP | 2012109669 | A | 6/2012 |

* cited by examiner

ROUTING CONDUCTORS TO ELECTRO-ACOUSTIC TRANSDUCER VOICE COILS

BACKGROUND

This disclosure relates to electro-acoustic transducers, and, more particularly, to routing conductors to electro-acoustic transducer voice coils. FIG. 1 shows a cross-sectional view of a conventional electro-acoustic transducer (a/k/a "transducer" or "driver").

A conventional electric-acoustic transducer 100 consists generally of an electric motor ("motor"), a cone assembly, and a suspension. The motor includes a magnetic circuit, and a voice coil assembly which is driven in motion by the magnetic circuit.

The magnetic circuit generally includes a back plate 102, a center pole 104, a front plate 106, and a permanent magnet 108 ("magnet"). The back plate 102, the center pole 104, and the front plate 106 are made of a magnetically permeable material such as iron or steel. The front plate 106 and the center pole 104 together form a gap 110 within which the voice coil assembly is disposed. The magnet 108 provides a permanent magnetic field to oppose an alternating electromagnetic field of the voice coil assembly and thereby cause the attached cone assembly to move upward and downward.

The voice coil assembly includes a voice coil 112 and a bobbin 114. The voice coil 112 is a coil of wire, usually copper or aluminum, through which an electrical audio signal flows. The flowing current of the audio signal alternates, creating an electromagnetic field which is opposed by the permanent magnetic field of the magnetic circuit. This causes the voice coil assembly and the cone assembly to move.

The cone assembly includes a cone 116 (a/k/a "diaphragm") and a dust cap 118. The cone 116, driven by the motor, moves like a piston to pump air and create sound waves. The dust cap 118 covers a hole in the center of the cone 116 and helps to reduce the amount of dust and dirt that can get into the gap 110 of the magnet 108, and it also adds strength and mass to the cone 116. The suspension includes a spider 120 and a surround 122. The spider 120 couples the bobbin 114 to a basket 124, and the surround 122 couples the cone 116 to the basket 124. The suspension assists in keeping the voice coil 112 centered, both axially and radially, within the gap 110 of the magnetic circuit.

The basket 124 (a/k/a "frame" or "chassis"), provides a rigid structure to which the other transducer components are mounted. It is commonly made of stamped steel, cast aluminum or plastic.

Conductors (a/k/a "leadout wires") are typically used to couple an input signal (current) from an external power source to the voice coil. In existing designs, the transducer often requires additional space to accommodate the conductors due to movement of the conductors during transducer operation. Without the additional space, the conductors may come in contact with other components within the transducer, which can lead to distortion and other undesirable effects on the sound being output from the transducer. To accommodate the additional space necessary for the conductors, the height (thickness) of the transducer is increased, resulting in an increased overall package size that may be undesirable in transducers having high excursion relative to the size of the transducer.

SUMMARY

All examples and features mentioned below can be combined in any technically possible way.

In one aspect, an electro-acoustic transducer includes a cone, a voice coil connected to the cone, and magnetic circuit that defines a gap within which the voice coil is disposed. The magnetic circuit is configured for creating magnetic flux across the gap for the voice coil to interact with, thereby to drive motion of the cone. A conductor is included for providing an input signal to the voice coil. A first portion of the conductor is fixedly secured to the magnetic circuit such that the first portion of the conductor does not move relative to the magnetic circuit while the cone is in motion.

Implementations may include one of the following features, or any combination thereof.

In some implementations, the magnetic circuit includes a back plate, a center pole connected to the back plate, a front plate, and a permanent magnet. The first portion of the conductor is fixedly secured to the front plate.

In certain implementations, at least the first portion of the conductor is electrically isolated from the front plate.

In some cases, the conductor is electrically connected to the front plate.

In certain cases, the conductor includes a pair of conductors, and the front plate includes a pair of front plate parts which are electrically isolated from each other, and each of the conductors is electrically connected to a corresponding one of the front plate parts.

In some examples, the permanent magnet is electrically isolated from at least one of the front plate parts.

In certain examples, the conductor also includes a second portion that is displaceable relative to the front plate, and the front plate defines a slot which accommodates relative movement of the second portion of the conductor.

In some implementations, the magnetic circuit may also include a bucking magnet coupled to an end of the center pole opposite the back plate.

In certain implementations, the conductor is electrically connected to the magnetic circuit.

In some cases, the conductor includes a second portion that is displaceable relative to the magnetic circuit, and the magnetic circuit defines a slot which accommodates relative movement of the second portion of the conductor.

In certain cases, the electro-acoustic transducer also includes a basket, and a suspension coupling the cone to the basket. The suspension has a double half roll configuration that includes a first half roll surround that has a first concave surface and a first convex surface, and a second half roll surround that has a second concave surface facing the first concave surface and a second convex surface facing the magnetic circuit.

In some examples, the cone has a concave surface which faces the magnetic circuit, and the magnetic circuit has a surface which substantially conforms to the concave surface of the cone such that the cone nests with the magnetic circuit.

In another aspect, an electro-acoustic transducer includes a cone, a voice coil connected to the cone, and a magnetic circuit that defines a gap within which the voice coil is disposed. The magnetic circuit is configured for creating magnetic flux across the gap for the voice coil to interact with, thereby to drive motion of the cone. A conductor provides an input signal to the voice coil. The magnetic circuit defines a slot which accommodates relative movement of the conductor.

Implementations may include one of the above and/or below features, or any combination thereof.

In some implementations, the magnetic circuit includes a back plate, a center pole connected to the back plate, a front plate, and a permanent magnet. The front plate defines a slot which accommodates relative movement of the conductor.

In certain implementations, the permanent magnet is disposed between the front plate and the back plate.

According to a further aspect, an electro-acoustic transducer includes a cone, a voice coil connected to the cone, and a magnetic circuit that defines a gap within which the voice coil is disposed. The magnetic circuit is configured for creating magnetic flux across the gap for the voice coil to interact with, thereby to drive motion of the cone along a motion axis. A conductor provides an input signal to the voice coil. The conductor is routed through a conduit formed in the magnetic circuit In some implementations, the magnetic circuit includes a back plate, a center pole connected to the back plate, a front plate, and a permanent magnet, and the conduit extends through the back plate, the center pole, or a combination thereof.

In certain implementations, the conduit is coaxial with the motion axis.

In some cases, the magnetic circuit also includes a bucking magnet coupled to an end of the center pole opposite the back plate, and the conduit extends through the back plate, the center pole, the bucking magnet, or a combination thereof.

Implementations can provide one or more of the following advantages.

In some implementations, a more compact, lower height transducer is provided.

In certain implementations, reduced clearance between a transducer cone and front plate is provided.

In some examples, addition clearance is provided for routing conductors in an electro-acoustic transducer without significantly affecting a force factor and motor efficiency of the transducer's magnetic circuit.

Other aspects, features, and advantages are in the description, drawings, and claims.

BRIEF DESCRIPTION OF THE DRAWINGS

Like reference numbers indicate like elements.

DETAILED DESCRIPTION

This disclosure is based, in part, on the realization that, in an electro-acoustic transducer, conductors can be routed directly from a stationary front plate to a moving voice coil in an area underneath a cone of the transducer.

Figure 2A:
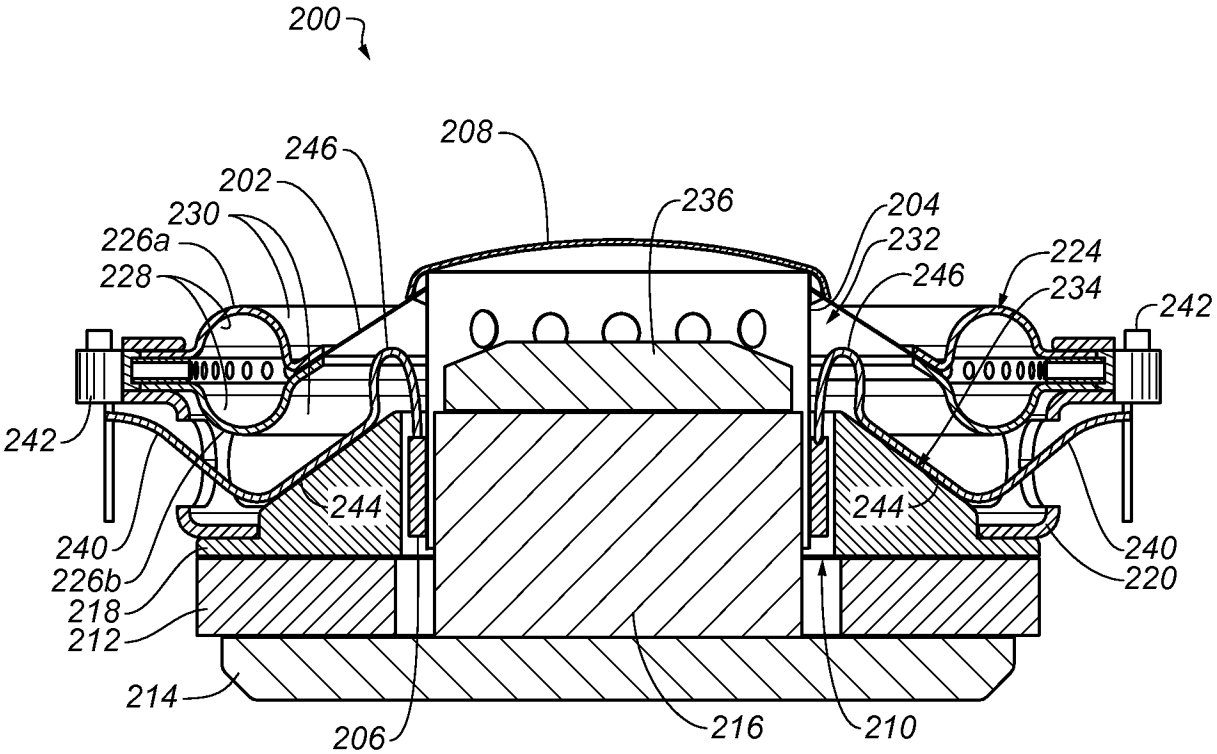
FIGS. 2A, 2B, and 2C are cross-sectional side views of a first implementation of an electro-acoustic transducer in accordance with this disclosure shown in a neutral position, a fully extended position, and a fully retracted position, respectively.
Figure 2B:
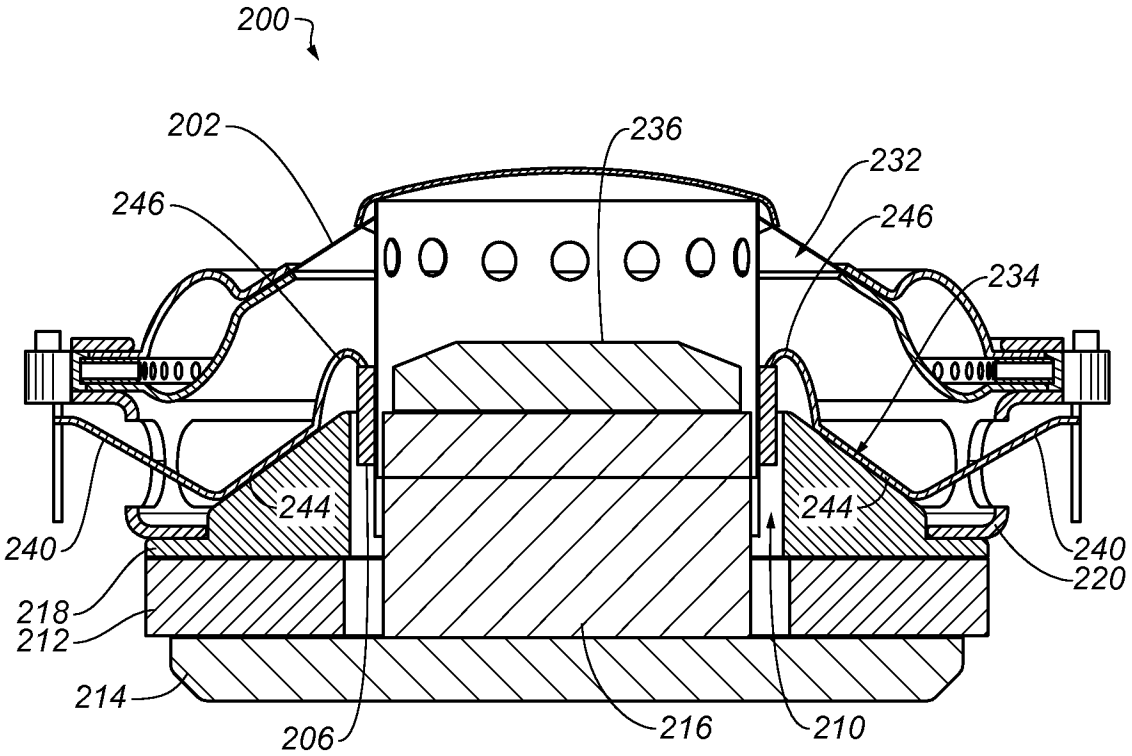
Figure 2C:
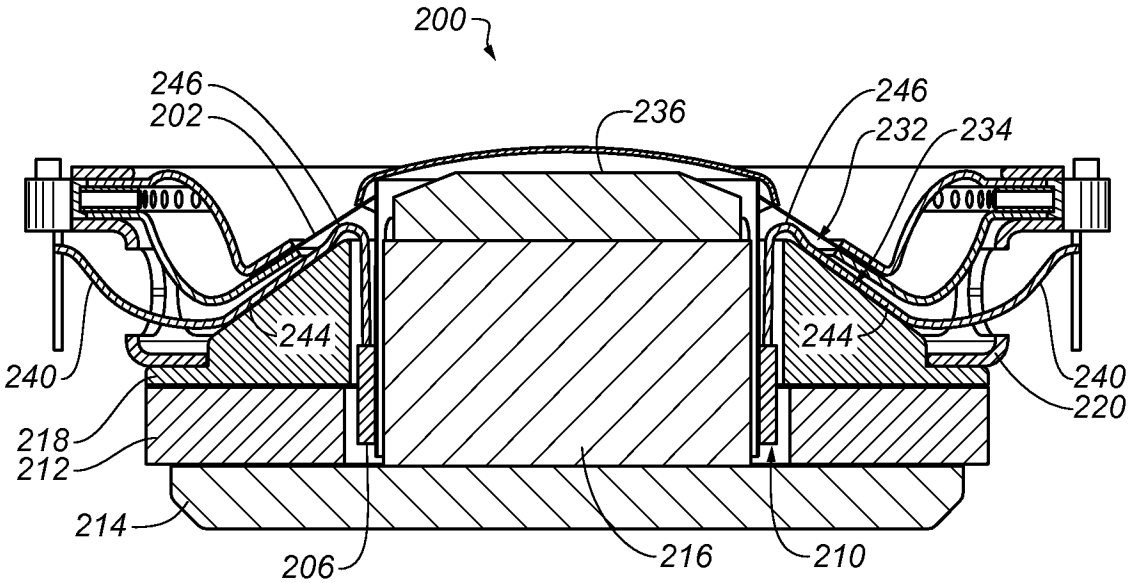

Referring now to the drawings, in which like numerals refer to like parts throughout the several views. Referring to FIG. 2A, an electro-acoustic transducer 200 includes a cone 202 connected to a voice coil assembly which includes a bobbin 204 and a voice coil 206. A dust cap 208 covers a top of the bobbin 204 on which the voice coil 206 is wound. The voice coil 206 is positioned in a gap 210 provided by a magnetic circuit formed from a permanent magnet 212, a back plate 214, a center pole 216, and a front plate 218. The magnetic circuit is configured for creating magnetic flux across the gap 210 which the voice coil 206 interacts with. When electrical current in the voice coil 206 changes direction, magnetic forces between the voice coil 206 and the magnetic circuit also change causing the voice coil 206 to move up and down in a pistonic motion between a fully extended position (FIG. 2B), in which the cone 202 is displaced away from the magnetic circuit, and a fully retracted position (FIG. 2C), in which the cone 202 is drawn inward towards the magnetic circuit.

An outer edge of the cone 202 is attached to a rigid basket 220 along an annular mounting flange by a suspension 224. Notably, the suspension 224 includes a pair of half roll surrounds (upper surround and lower surround 226*a*, 226*b*) each having a concave inner surface 228 and an opposing convex outer surface 230. The surrounds 226*a*, 226*b* are arranged such that their concave surfaces 228 face each other. The two surrounds 226*a*, 226*b* of this double half shell configuration provide for rocking stability which can eliminate the need for a separate spider.

Figure 1:
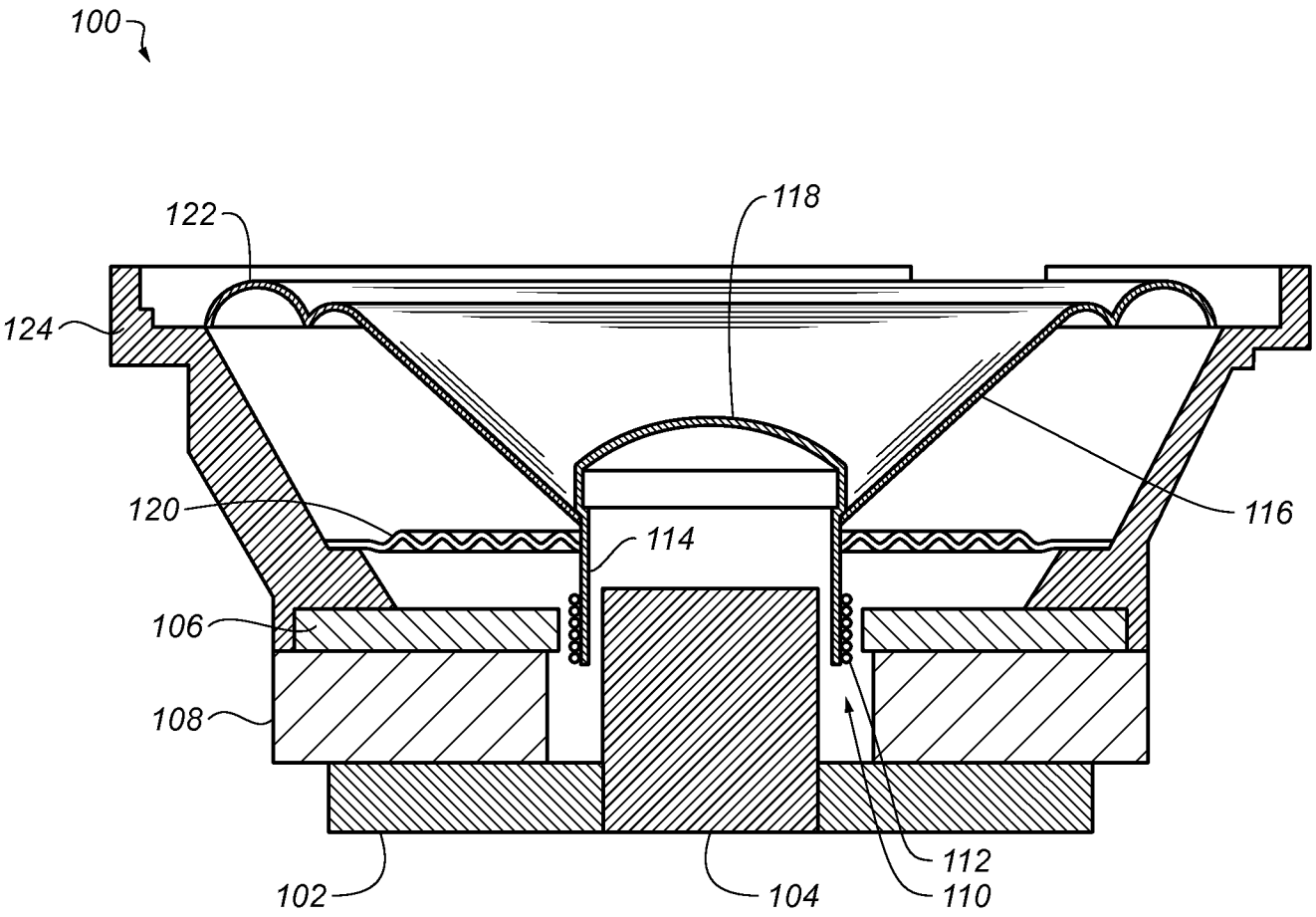
FIG. 1 (PRIOR ART)
FIG. 1 is a cross-sectional side view of a prior art electro-acoustic transducer.

The lack of a spider can help to accommodate inversion of the cone 202 from a more conventional orientation, such as that illustrated in FIG. 1. In this inverted orientation, the cone 202 nests with the magnetic circuit. As shown in FIG. 2A, the cone 202 is oriented such that a concave surface 232 of the cone 202 faces toward the front plate 218, and the front plate 218 has an outer surface 234 which substantially conforms to the concave surface 232 of the cone 202. As a result, when the cone 202 is in a fully retracted (full down/fully retracted) position (FIG. 2C) there is very little volume of air left between the cone 202 and the front plate 218. This nesting of the cone 202 with the magnetic circuit helps to reduce the overall vertical height, or thickness (t), of the transducer 200.

The back plate 214, center pole 216, and front plate 218 are each formed of a magnetizable material, such as steel. In some implementations, the back plate 214 and the center pole 216 may be formed as a single integral part. The basket 220 can be formed of a rigid, magnetically non-permeable material, such as aluminum. Alternatively or additionally, the basket 220 can be formed of a magnetically permeable material, such as steel.

As shown in FIG. 2A, the transducer 200 may also include a bucking magnet 236 disposed at an end of the center pole 216 opposite the back plate 214. The bucking magnet 236 bucks the magnetic field to inhibit the magnetic flux from fringing out away from the gap 210. The bucking magnet 236 is another permanent magnet and may be formed of the same material as the permanent magnet 212, such as a ferrous ceramic material. The additional magnet material of the bucking magnet 236 can also help to provide for a stronger motor.

An input signal (current) is provided to the voice coil 206 via conductors 240, such as tinsel wire or beryllium-copper flat wire. The absence of a spider can also help to free up space underneath the cone 202 to accommodate routing of the conductors 240. As shown in FIG. 2A, the conductors 240 can be routed (e.g., from a respective terminal 242 attached to the basket 220) towards the front plate 218, and then can follow the profile of the front plate 218 before attaching to the voice coil 206. Respective first portions 244 of the conductors 240 can be fixedly attached to the outer surface the front plate 218, e.g., via an adhesive, so as to inhibit relative movement between the first portions 244 of the conductors 240 and the front plate 218. The conductors 240 are electrically isolated from the front plate 218. In that regard, the conductors 240 may have a sheath or layer of electrically non-conductive material for electrically isolating the conductors 240 from the front plate 218.

A service loop 246, a second (free) portion, is included in each of the conductors 240 before it is attached to the voice coil 206, to help prevent breakage of the conductor 240. In other words, rather than taking the shortest, most direct path to the voice coil 206, some additional length is provided to the conductors 240. By increasing the free length of the conductors 240, the amount of strain is reduced which can help to prevent breakage of the conductors 240. The additional length, or "service loop", can take on multiple forms or shapes, including a curved shape (as shown in FIG. 2A), a coiled shape, a wave shape, etc.

Figure 3A:
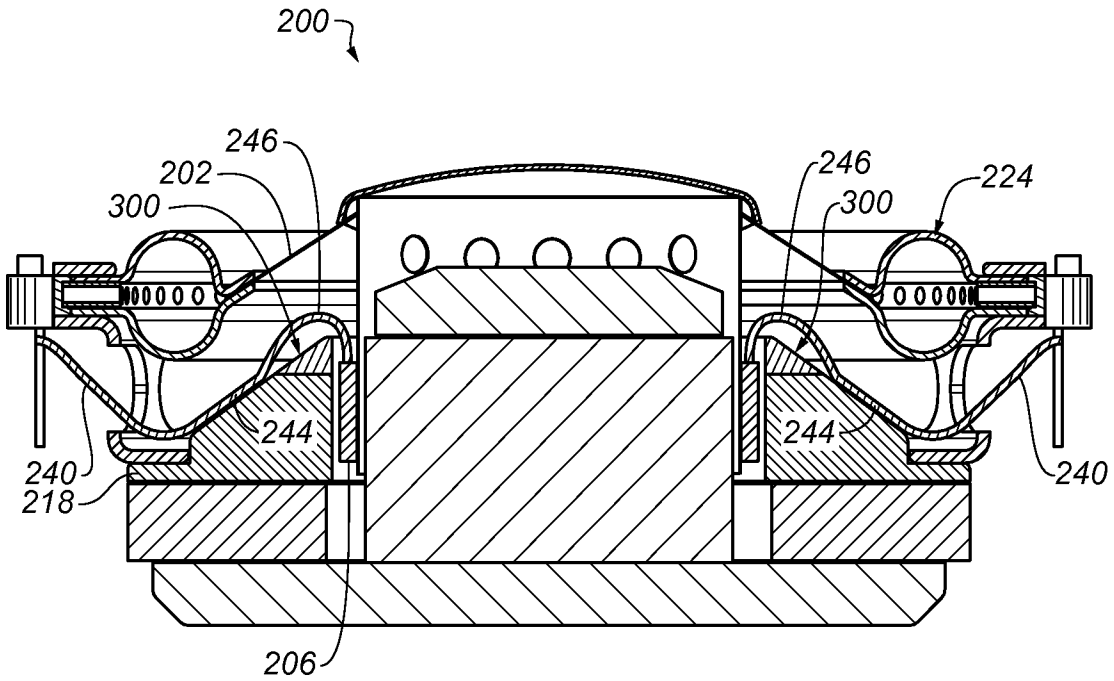
FIGS. 3A and 3B are cross-sectional side views of a second implementation of an electro-acoustic transducer in accordance with this disclosure shown in a neutral position and a fully retracted position, respectively.
Figure 3B:
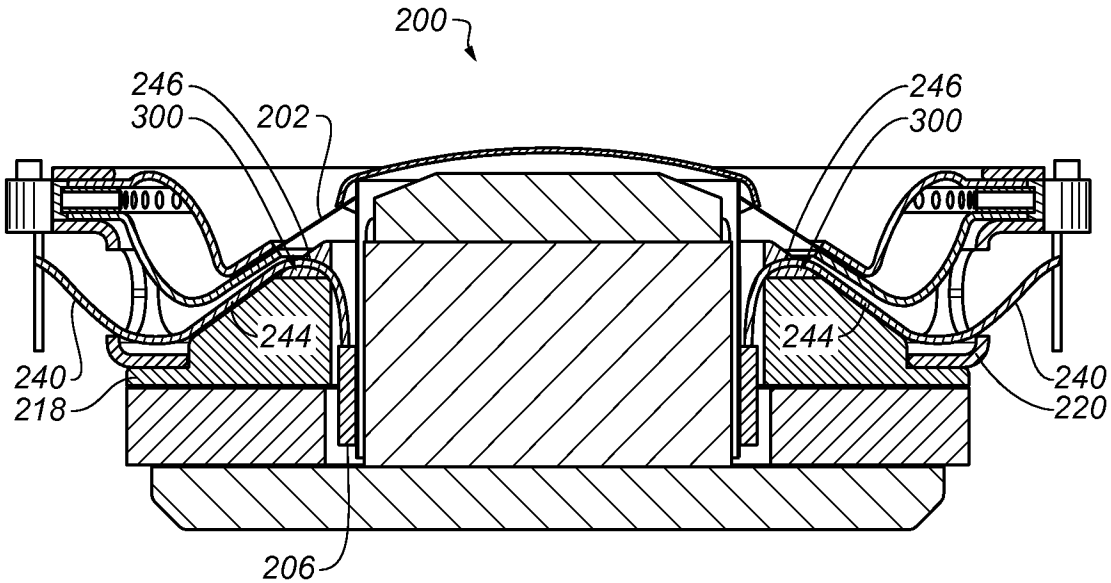

In some implementations, to increase the length of the service loop 246, and enable greater excursion, one or more slots 300 (FIG. 3A) can be formed in the front plate 218 to help accommodate the conductors 240. At least part of the service loop 246 of the conductors 240 is received in the slots 300 as the cone 202 is displaced into the retracted position (FIG. 3B). The slots 300 are generally large enough to accommodate both vertical movement of the conductors 240 during stroke of the transducer 200 as well as provide side-to-side clearance so the service loops 246 do not contact the front plate 218.

Figure 4A:
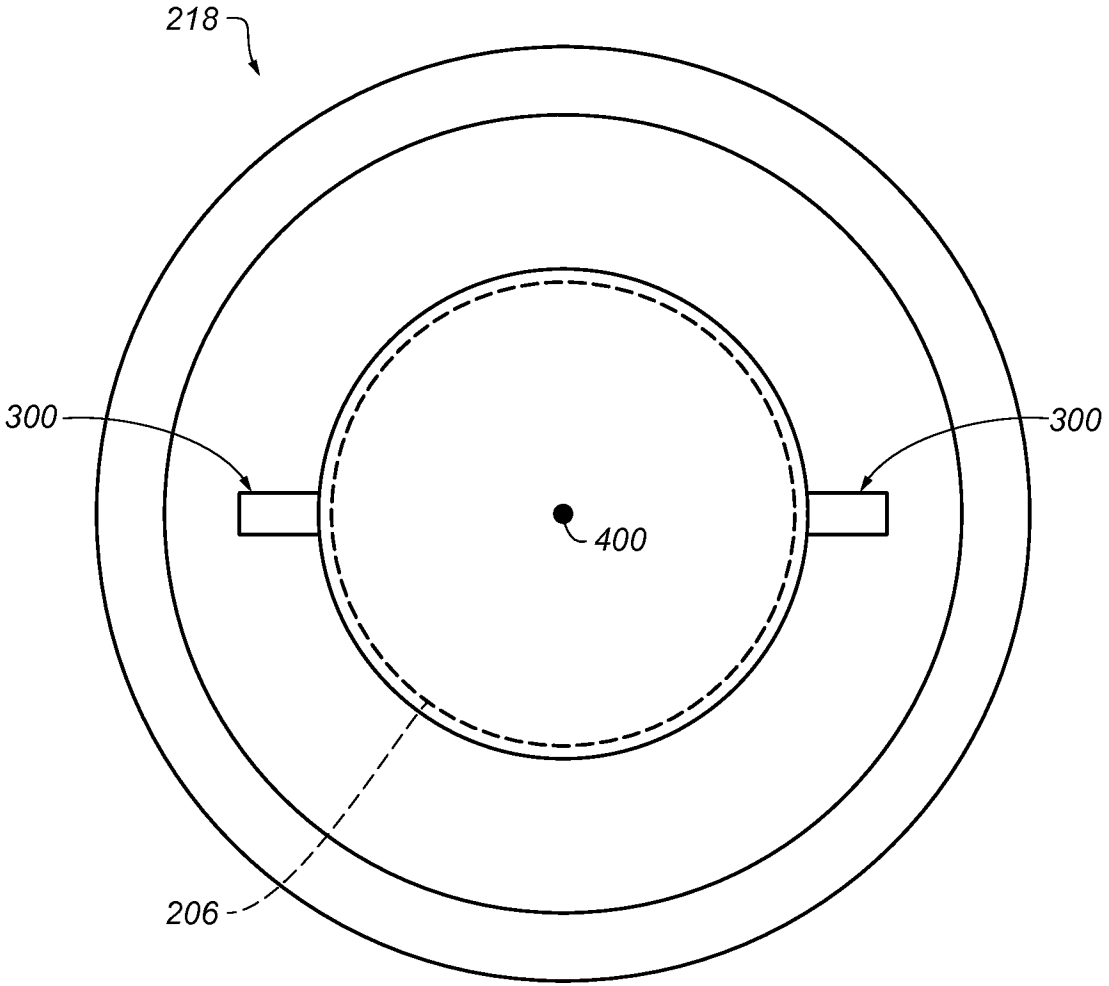
FIG. 4A is a top view of a front plate that can be used in the transducer of FIG. 3A.
Figure 4B:
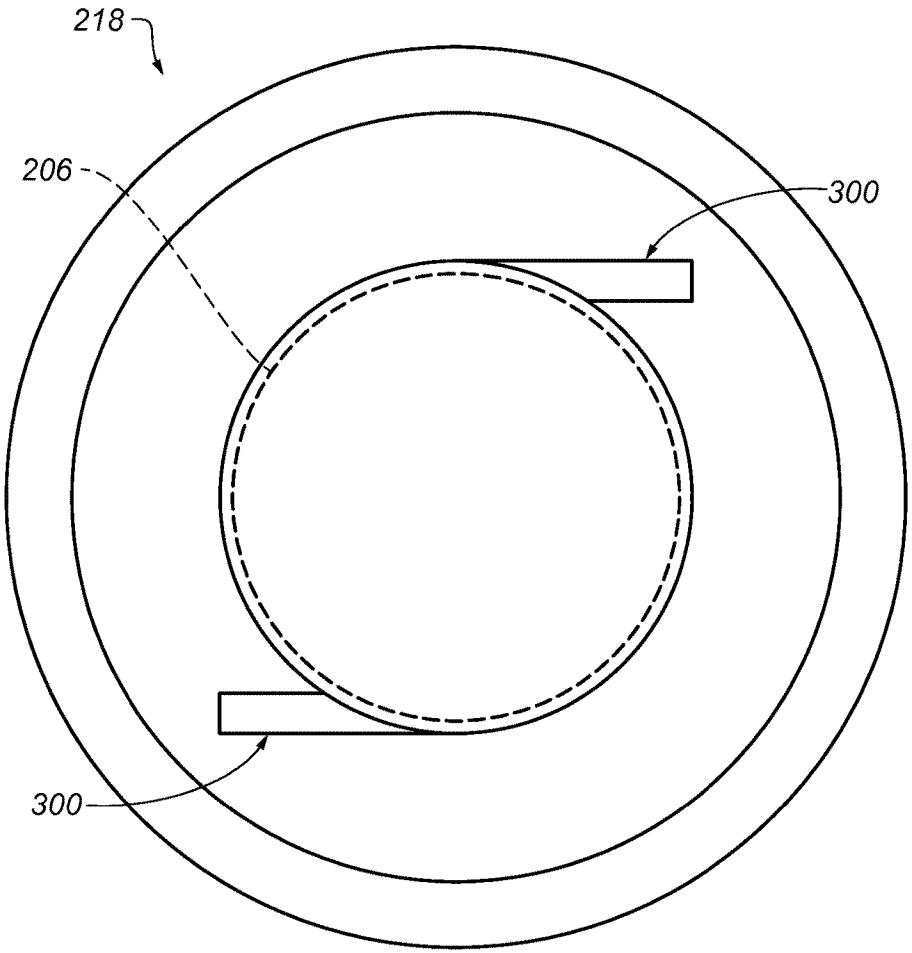
FIG. 4B is a top view of an alternative front plate that can be used in the transducer of FIG. 3A.

The slots 300 may include one or more axial slots (FIG. 4A) which extend out perpendicularly from and intersect a motion axis 400 of the transducer 200. Alternatively or additionally, the slots 300 may include one or more radial slots (FIG. 4B) which extend out substantially tangent to an outer diameter of the voice coil 206.

Figure 5:
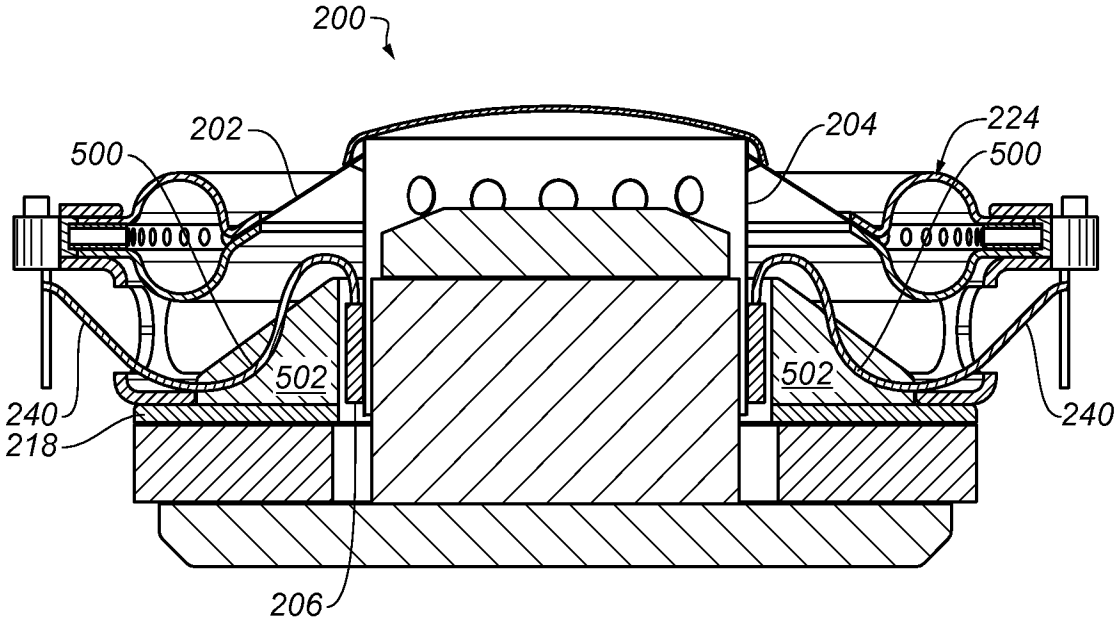
FIG. 5 is a cross-sectional side view of a third implementation of an electro-acoustic transducer in accordance with this disclosure.
Figure 6A:
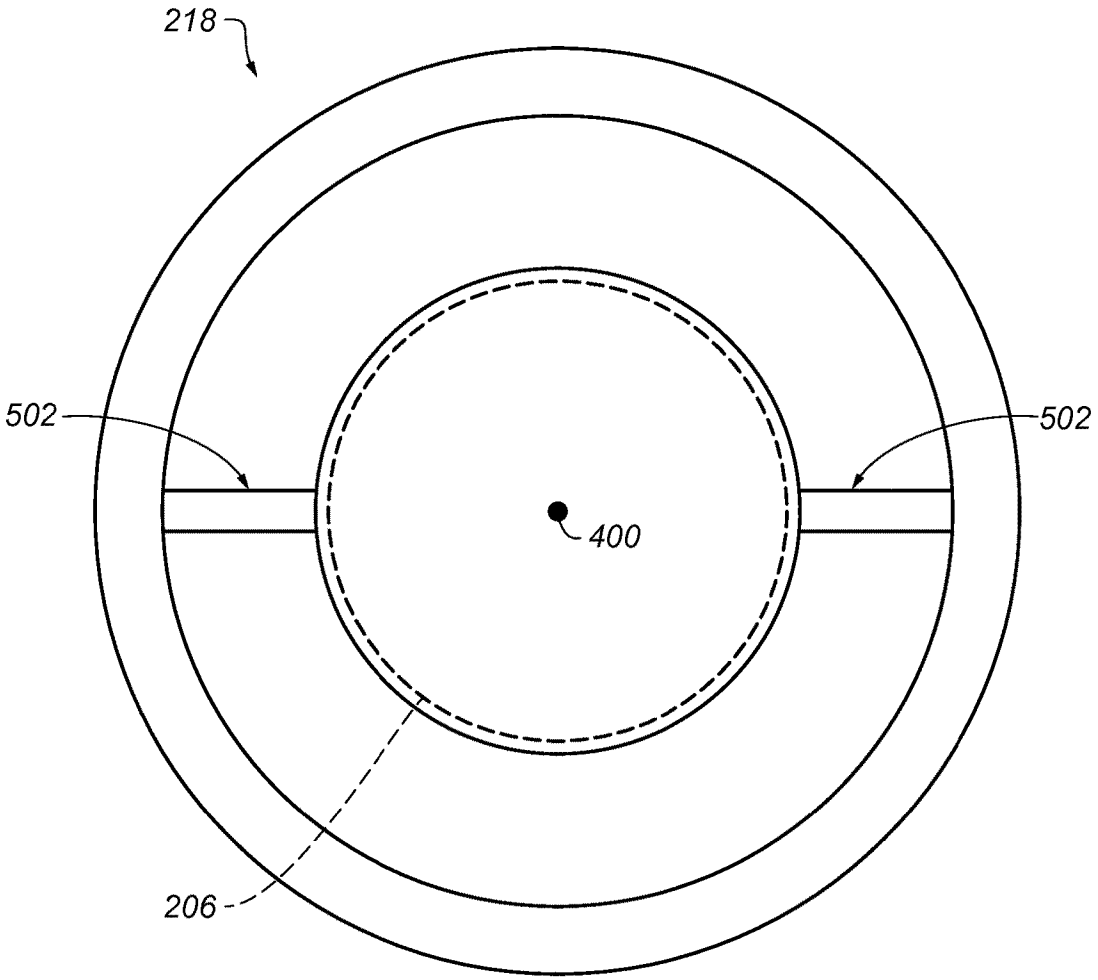
FIG. 6A is a top view of a front plate that can be used in the transducer of FIG. 5.
Figure 6B:
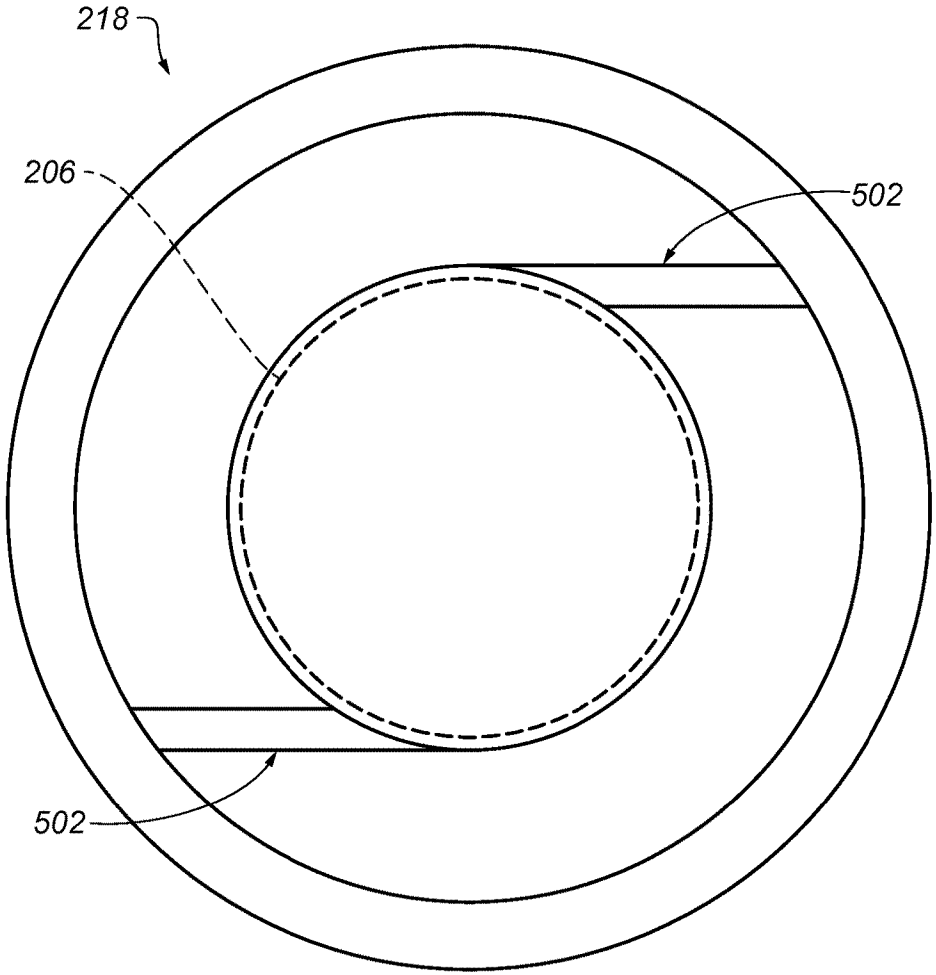
FIG. 6B is a top view of an alternative front plate that can be used in the transducer of FIG. 5.

While an example of a transducer has been described in which portions of the conductors are fixedly secured to the front plate of the transducer, FIG. 5 shows an implementation of the transducer 200 in which the conductors 240 are not fixedly secured to the front plate 218. Instead, free lengths 500 of the conductors 240 extends substantially between the terminal ends of the conductors 240 and are free to move relative to the front plate 218 and the cone 202. The free lengths 500 of the conductors 240 are accommodated in slots 502 formed in the front plate 218 and are otherwise free to move relative to the front plate 218. The slots 502 extend substantially through the front plate 218 and are sized to accommodate both vertical movement of the conductors 240 during stroke of the transducer 200 as well as provide side-to-side clearance so the conductors 240 do not contact the front plate 218. The slots 502 may be axial slots (FIG. 6A) which extend perpendicular to and intersect the motion axis 400 of the transducer 200, or the slots 502 may be radial slots (FIG. 6B) which are substantially tangent to the outer diameter of the voice coil 206.

Figure 7A:
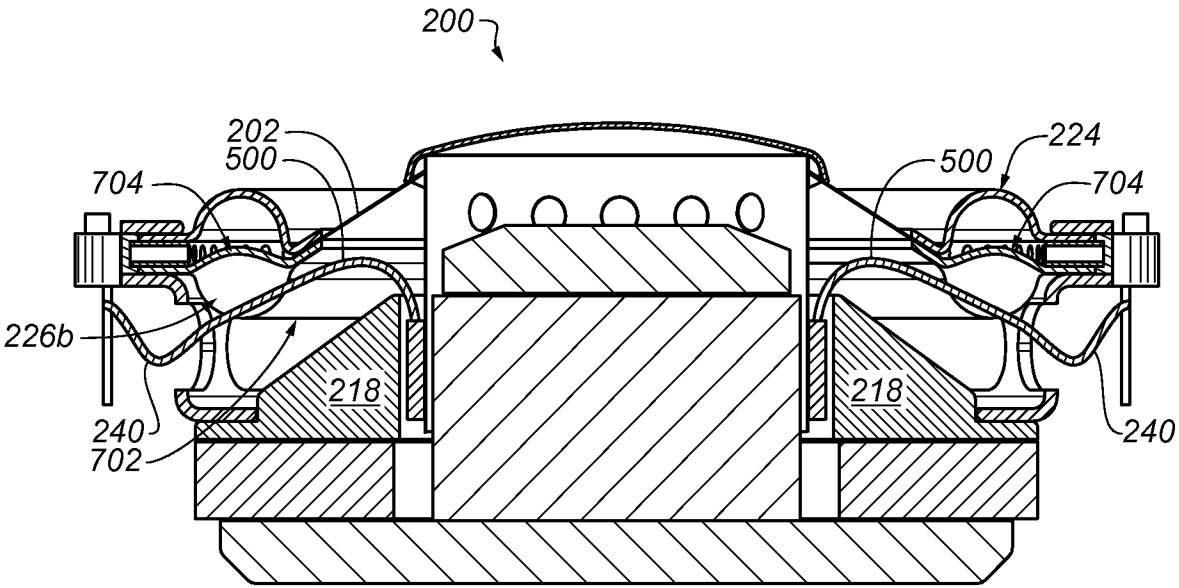
FIG. 7A is a cross-sectional side view of a fourth implementation of an electro-acoustic transducer in accordance with the present disclosure.
Figure 7B:
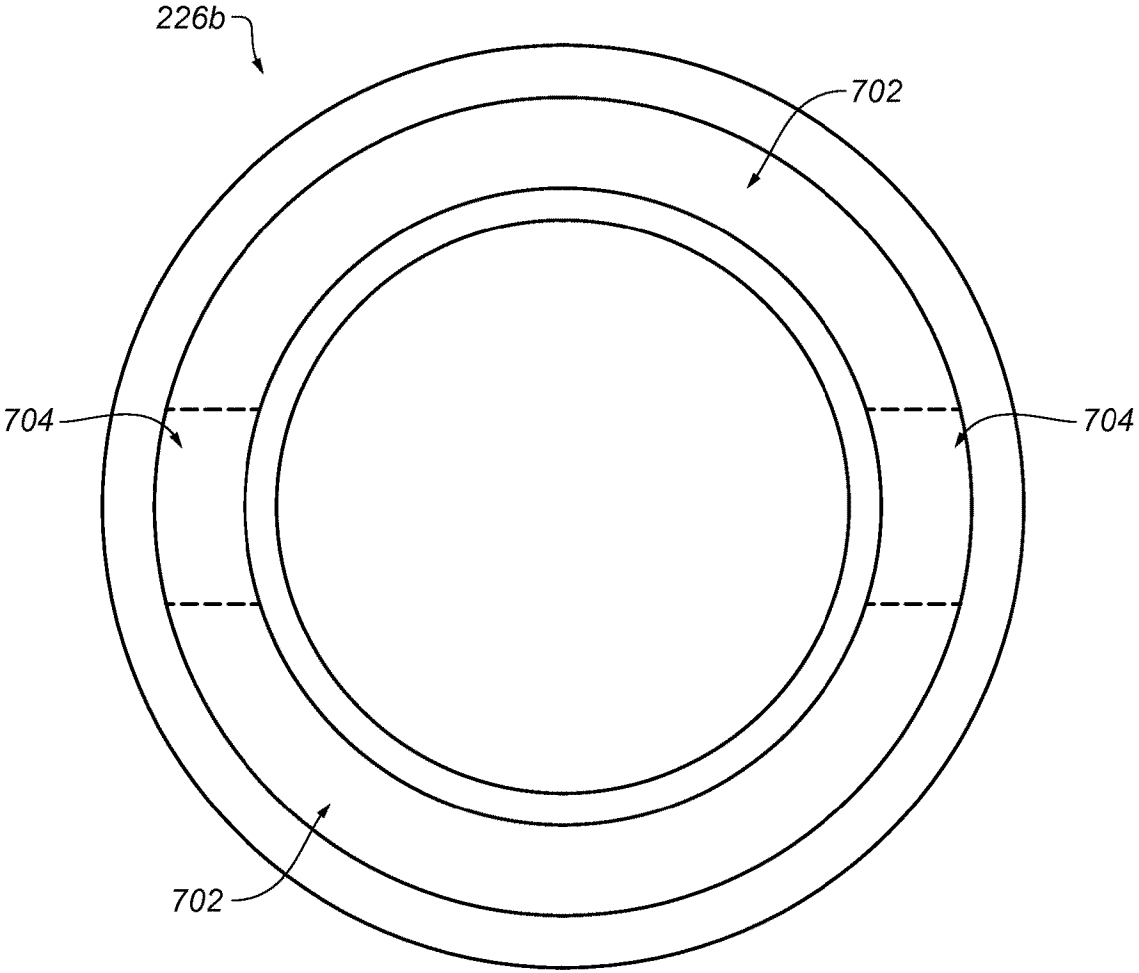
FIG. 7B is a bottom view of a suspension element that can be used in the transducer of FIG. 7A.

Alternatively or additionally, some implementations may include one or more segments of contrasting concavity formed in the lower surround 226*b* to accommodate part of the free length 500 of the conductors 240. For example, FIG. 7A illustrates an implementation of the transducer 200 in which the lower surround 226*b* includes adjacent segments characterized by inversion of concavity and smooth inflections therebetween. In the illustrated example, there are two half roll segments 702 (see also FIG. 7B) and two inverted half roll segments 704. Each half roll segment 702 may be characterized by a curved radial cross-section (e.g., elliptical segment, sometimes semi-circular) defined by a plane which contains the primary axis of excursion of the suspension 224 and the cone 202. A convex surface of each half roll segment 702 of the lower surround 226*b* faces the front plate 218. The inverted half roll segments 704 may also be characterized by curved radial cross-sections (e.g., elliptical segments, sometimes semi-circular), but the concave surfaces of the inverted half roll segments 704 face the front plate 218. Additional examples of surrounds having segments of differing concavity are described in U.S. patent application Ser. No. 14/085,938, titled "SURROUND WITH VARIATIONS OF CONCAVITY," filed Nov. 21, 2013, the complete disclosure of which is incorporated herein by reference.

The inverted half roll segments 704 are arranged to overlie the conductors 240 so as to create addition clearance in the area of the lower surround 226*b* for accommodating movement of the conductors 240. These inverted half roll segments 704 are generally sized to accommodate both vertical movement of the conductors 240 during stroke of the transducer 200 as well as provide side-to-side clearance so the free lengths 500 of the conductors 240 do not contact the lower surround 226*b*. These inverted segments 704 can be used alone, or in combination with slots (FIG. 5) in the front plate 218, to accommodate movement of the conductors 240.

Figure 8:
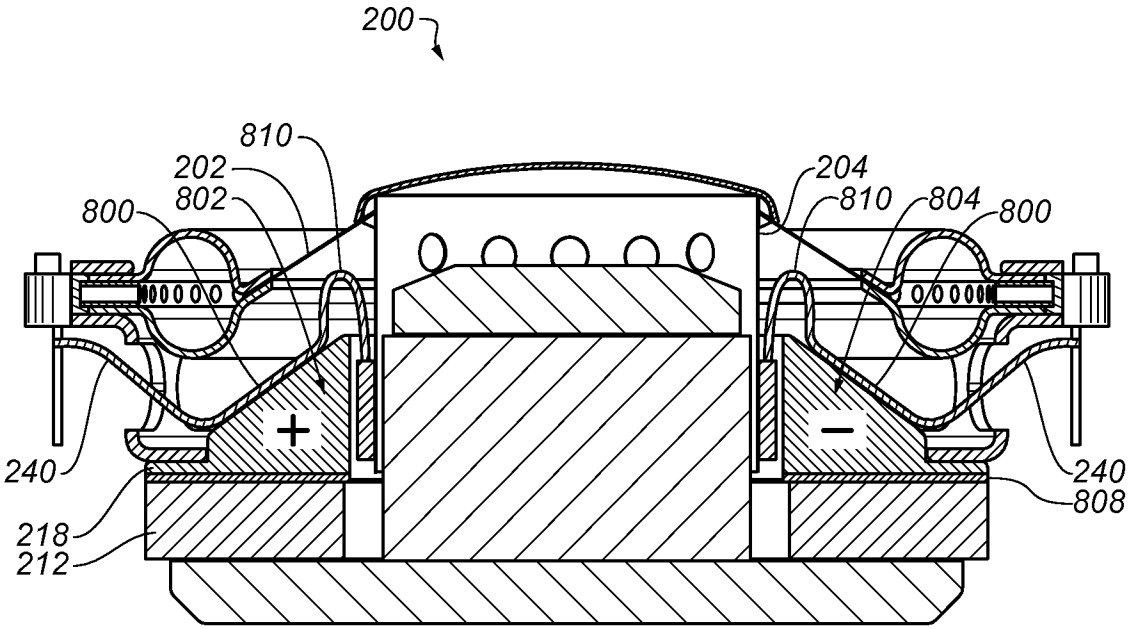
FIG. 8 is a cross-sectional side view of a fifth implementation of an electro-acoustic transducer in accordance with the present disclosure.

In some implementations, the conductors 240 may be mechanically and electrically secured to the front plate 218. For example, FIG. 8 illustrates an implementation of the transducer 200 in which respective first portions 800 of the conductors 240 can be secured to the outer surface the front plate 218 via solder or an electrically conductive adhesive, so that the conductors 240 are mechanically and electrically attached to the front plate 218. In this configuration, the front plate 218 can be split into two halves or parts, each having a corresponding one of the conductors 240 mechanically and electrically secured to it such that the two plate parts (first and second plate parts 802 and 804, respectively) are electrically opposite with current running through both sides/parts 802, 804 of the front plate 218.

Figure 9:
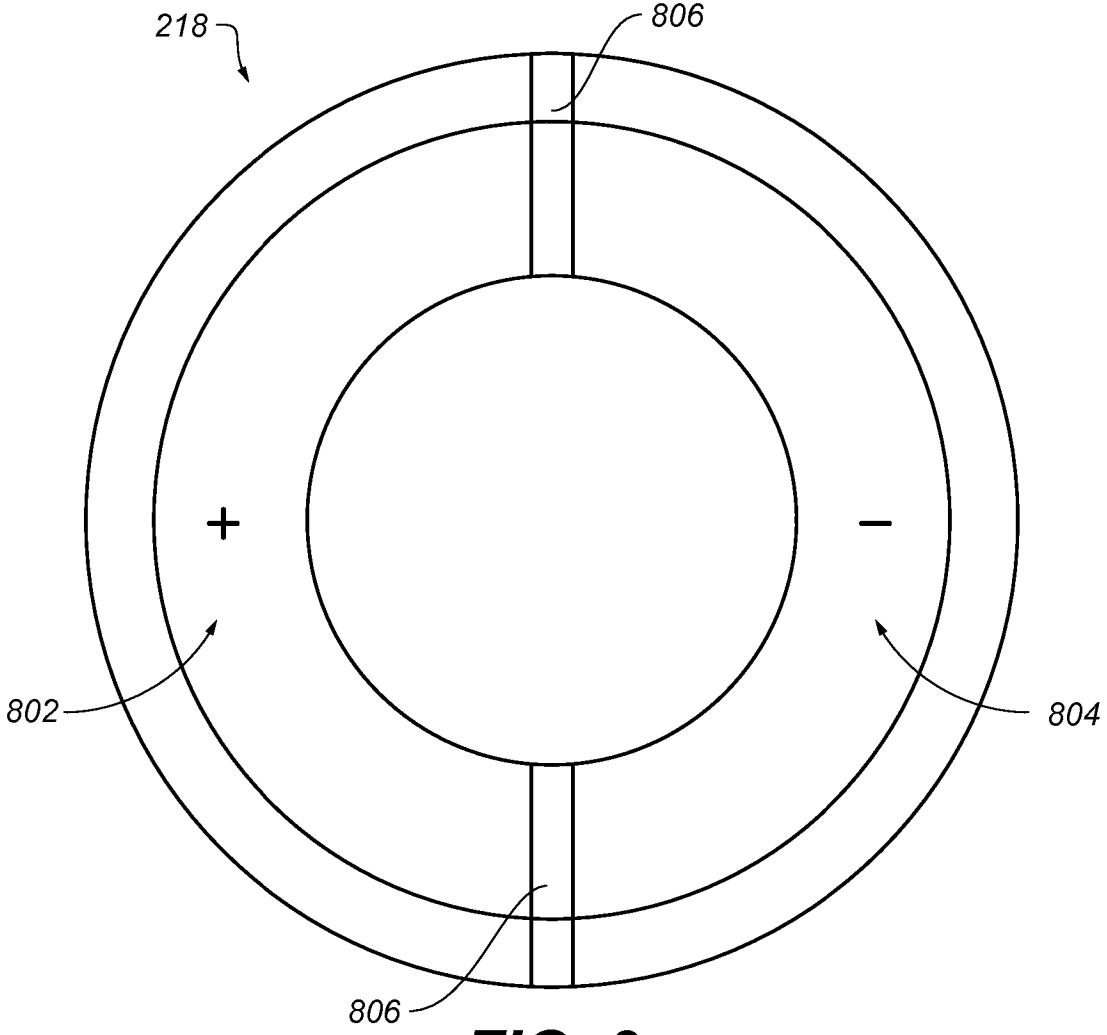
FIG. 9 is a top view of a front plate from the transducer of FIG. 8.

As shown in FIG. 9 (top view of front plate), the first and second plate parts 802, 804 can be separated by an electrical insulator 806. For example, the first and second plate parts 802, 804 may be adhered to one another with an electrically non-conductive adhesive so that the two parts 802, 804 remain electrically isolated. To inhibit electrical conduction through the magnet 212, electrically insulating material 808 (FIG. 8) may also be disposed between the front plate 218 and the magnet 212. In some cases, the same material may be used to electrically isolate the front plate parts 802, 804 from each other and also to electrically isolate the magnet 212 from the front plate 218. As in the implementations described above, slots may be provided in the front plate 218 (i.e., respective slots in the front plate parts) for accommodating service loops 810 formed in the conductors 240.

Figure 10:
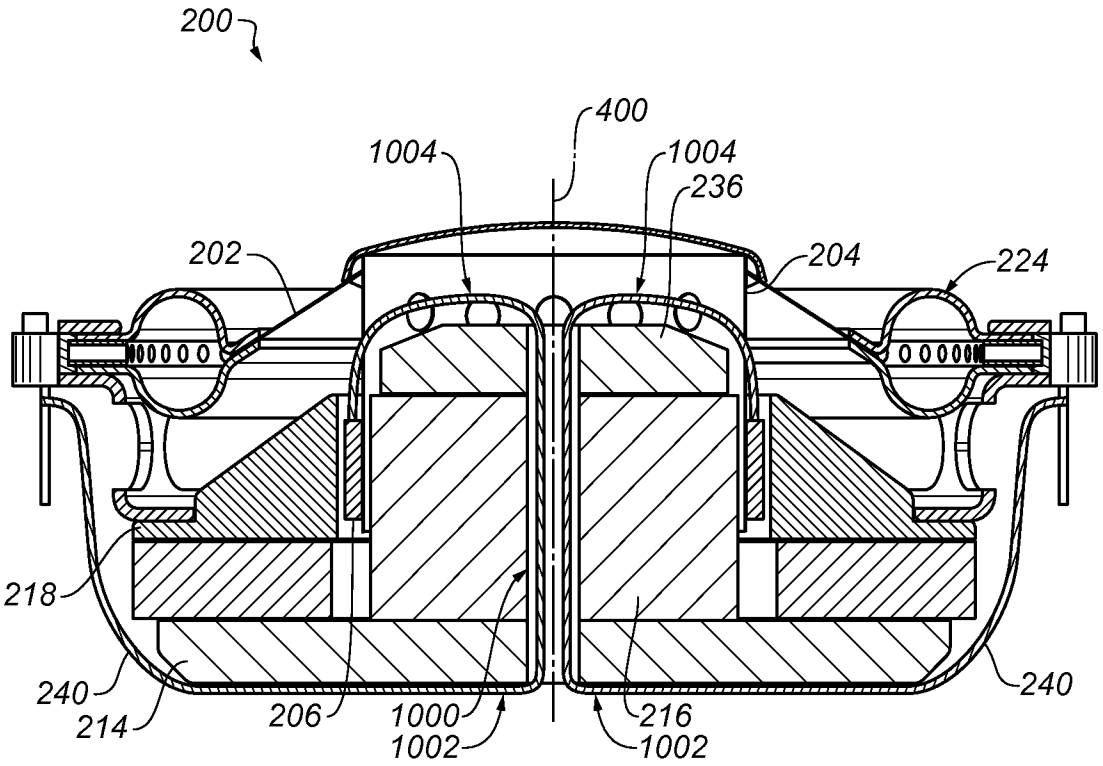
FIG. 10 is a cross-sectional side view of a sixth implementation of an electro-acoustic transducer in accordance with the present disclosure.

FIG. 10 illustrates yet another implementation of the transducer 200 in which the conductors 240 are routed through a conduit 1000 that is formed in the magnetic circuit. In the illustrated example the conduit 1000 extends through the back plate 214, the center pole 216, and the bucking magnet 236. The conduit can be coaxial with the motion axis 400 of the transducer 200. First portions 1002 of the conductors 240 can be secured, e.g., via adhesive, to the back plate 214, to the center pole 216, and/or to the bucking magnet 236. Service loops 1004 formed in the conductors 240 wrap around the bucking magnet 236, pass through openings in the bobbin 204, and are attached to respective terminal ends of the voice coil 206. The conductors 240 are electrically isolated from the back plate 214, the center pole 216, and the bucking magnet 236.

In some instances, the conduit may also serve as a vent to prevent pressure from building behind the cone 202 in the magnetic circuit and/or to provide cooling of the voice coil.

In some cases, one or more slots may be formed in the center pole 216 and/or the bucking magnet 236 to accommodate movement of the conductors 240. The slots can be sized to accommodate both vertical movement of the conductors 240 during stroke of the transducer 200 as well as provide side-to-side clearance so the service loops 1004 (a/k/a "free lengths") of the conductors 240 do not contact the bobbin 204 or the components of the magnetic circuit.

A number of implementations have been described. Nevertheless, it will be understood that additional modifications may be made without departing from the scope of the inventive concepts described herein, and, accordingly, other implementations are within the scope of the following claims.

What is claimed is:

1. An electro-acoustic transducer comprising:
a cone;
a voice coil connected to the cone;
a magnetic circuit including a front plate and defining a gap within which the voice coil is disposed, the magnetic circuit being configured for creating magnetic flux across the gap for the voice coil to interact with, thereby to drive motion of the cone; and
a conductor for providing an input signal to the voice coil, wherein a first portion of the conductor is fixedly secured to the front plate such that the first portion of the conductor does not move relative to the magnetic circuit while the cone is in motion, and wherein at least the first portion of the conductor is electrically isolated from the front plate, wherein the conductor further comprises a second portion that is displaceable relative to the front plate, and wherein the front plate defines a radial slot which accommodates relative movement of the second portion of the conductor.

2. The electro-acoustic transducer of claim 1, wherein the magnetic circuit comprises:
a back plate;
a center pole connected to the back plate; and
a permanent magnet,
wherein the first portion of the conductor is fixedly secured to the front plate.

3. The electro-acoustic transducer of claim 1, wherein the conductor comprises a pair of conductors, and the front plate comprises a pair of front plate parts which are electrically isolated from each other.

4. The electro-acoustic transducer of claim 3, wherein the permanent magnet is electrically isolated from at least one of the front plate parts.

5. The electro-acoustic transducer of claim 1, wherein the magnetic circuit comprises:
a back plate;
a center pole connected to the back plate;
a permanent magnet; and
a bucking magnet coupled to an end of the center pole opposite the back plate.

6. The electro-acoustic transducer of claim 1, further comprising:
a basket; and
a suspension coupling the cone to the basket, the suspension having a double half roll configuration comprising a first half roll surround having a first concave surface and a first convex surface, and a second half roll surround having a second concave surface facing the first concave surface and a second convex surface facing the magnetic circuit.

7. The electro-acoustic transducer of claim 1, wherein the cone has a concave surface which faces the magnetic circuit, and the magnetic circuit has a surface which substantially conforms to the concave surface of the cone such that the cone nests with the magnetic circuit.

8. An electro-acoustic transducer comprising:
a cone;
a voice coil connected to the cone;
a magnetic circuit including a front plate and defining a gap within which the voice coil is disposed, the magnetic circuit being configured for creating magnetic flux across the gap for the voice coil to interact with, thereby to drive motion of the cone; and
a conductor for providing an input signal to the voice coil, wherein the front plate defines a radial slot which accommodates relative movement of the conductor.

9. The electro-acoustic transducer of claim 8, wherein the magnetic circuit comprises:
a back plate;
a center pole connected to the back plate;
and
a permanent magnet.

10. The electro-acoustic transducer of claim 8, further comprising:
a basket; and
a suspension coupling the cone to the basket, the suspension having a double half roll configuration comprising a first half roll surround having a first concave surface and a first convex surface, and a second half roll surround having a second concave surface facing the first concave surface and a second convex surface facing the magnetic circuit.

11. The electro-acoustic transducer of claim 8, further comprising:
a basket; and
a suspension coupling the cone to the basket, the suspension comprising a surround having a segments of differing concavity including at least one half roll segment having a convex surface which faces the magnetic circuit, and a least one inverted half roll segment having a concave surface which faces the magnet circuit and which is arranged to accommodate relative movement of the conductor.

12. The electro-acoustic transducer of claim 8, wherein the cone has a concave surface which faces the magnetic circuit, and magnetic circuit has a surface which substantially conforms to the concave surface of the cone such that the cone nests with the magnetic circuit.

13. The electro-acoustic transducer of claim 8, wherein the magnetic circuit comprises:

a back plate;

a center pole connected to the back plate;

a permanent magnet; and a bucking magnet coupled to an end of the center pole opposite the back plate.

14. An electro-acoustic transducer comprising:

a cone;

a voice coil connected to the cone;

a magnetic circuit defining a gap within which the voice coil is disposed, the magnetic circuit being configured for creating magnetic flux across the gap for the voice coil to interact with, thereby to drive motion of the cone;

a conductor for providing an input signal to the voice coil;

a basket; and a suspension coupling the cone to the basket, the suspension comprising a surround having segments of differing concavity including at least one half roll segment having a convex surface which faces the magnetic circuit, and a least one inverted half roll segment having a concave surface which faces the magnet circuit and which is arranged to accommodate relative movement of the conductor, circumferentially adjacent segments of the surround being characterized by inversion of concavity.

15. The electro-acoustic transducer of claim 14, further comprising an electrical terminal coupled to the basket, wherein the conductor electrically connects the voice coil to the electrical terminal.

16. The electro-acoustic transducer of claim 14, wherein the cone has a concave surface which faces the magnetic circuit, and magnetic circuit has a surface which substantially conforms to the concave surface of the cone such that the cone nests with the magnetic circuit.

* * * * *